US005572891A

United States Patent [19]

Klein et al.

[11] Patent Number: 5,572,891

[45] Date of Patent: Nov. 12, 1996

[54] CAN BODY MAKING APPARATUS

[75] Inventors: Greg Klein, Fairfield; Allen Omernick, Cincinnati, both of Ohio

[73] Assignee: OKL Can Line, Cincinnati, Ohio

[21] Appl. No.: 347,609

[22] Filed: Dec. 1, 1994

[51] Int. Cl.[6] ..... B21D 24/10

[52] U.S. Cl. ..... 72/20.5; 72/361

[58] Field of Search ..... 72/23, 24, 29, 72/349, 361, 20.5

[56] References Cited

U.S. PATENT DOCUMENTS 3,628,368 12/1971 Cvacho ..... 72/361
4,120,185 10/1978 Schneider et al. ..... 72/24
4,928,511 5/1990 Sirvet ..... 72/361
5,129,252 7/1992 Hahn et al. ..... 72/349
5,301,534 4/1994 Nishikawa et al. ..... 72/361

FOREIGN PATENT DOCUMENTS 3219998 12/1982 Germany ..... 72/23

*Primary Examiner*—Lowell A. Larson
*Attorney, Agent, or Firm*—Dinsmore & Shohl

[57] ABSTRACT

A can body making apparatus has an encoder that generates a signal representative of the angular position of the crankshaft. The signal is input to a controller that controller an feeding mechanism in phased timed relationship to the rotation of the crankshaft allowing greater control of the feeding mechanism.

7 Claims, 2 Drawing Sheets

CAN BODY MAKING APPARATUS

TECHNICAL FIELD

The invention relates generally to machines for making metal can bodies, and more particularly to an apparatus for forming metal can bodies from cup-shaped blanks. The invention will be specifically disclosed in connection with a system for controlling the infeed of cup-shaped blanks to a ram punch used for forcing the blanks through a series of dies that transform the blanks into can bodies.

BACKGROUND OF THE INVENTION

In the making of metal cans, such as aluminum cans of the type typically used for beverages, it is common practice to form the bodies of the cans from pre-drawn cup-shaped blanks in a body making apparatus. The cup-shaped blanks are transformed into can bodies by striking the blanks with a punch ram and forcing them through a series of progressive dies that, in essence, stretch and elongate the sidewalls of the blanks. The punch ram typically is carried on a reciprocating ram carriage that is rollably movable on a horizonal way system. The punch ram is moved on the horizonal way system by a rotating crankshaft that is driven by a motor and flywheel.

A body making apparatus also typically includes a feeder mechanism for segregating a single cup blank from queued plurality of cup blanks and placing the single cup blank into a locator structure that aligns and properly positions the blank to be contacted by the punch ram. One common type of feeder mechanism in contemporary commercial use is a rotary cup blank feed in which the pre-drawn cup blanks are loaded from the top and indexed to a position adjacent to a rotating cam. When the cup blank is properly aligned and positioned, a redraw sleeve, carried by a redraw carriage, is moved into the internal portion of the cup blank into concentric relationship with the sidewall of the cup blank. The punch ram thereafter is moved through the redraw sleeve to contact the bottom of the cup blank and to force the blank through the series of progressive dies. It is critically important to properly and accurately feed and place the cup blank in the locator structure before it is contacted by the punch ram. Misfeeding the blank will cause the redraw sleeve to "clip out" or otherwise tear the sidewalls of the cup blank, and the punch ram will force the torn metal into the dies. Such action not only destroys the cup blank, it also can cause serious damage to the dies and the punch ram.

It obviously is important to synchronize the movement of the feeder mechanism with the movement of the punch ram so that the cup blank is placed in the locator structure in timed relationship with the stroke of the punch ram. In order to insure the necessary phased relationship between the rotation of the crankshaft, which moves the ram carriage, and the feeder mechanism, prior art body making machines have mechanically interconnected the drive train of the feeding mechanism to the drive train of the ram carriage. However, the feeder mechanism must, of necessity, be located proximal to the locator structure, which usually is at the opposite end of the body making machine from the crankshaft. The feeder mechanism also is at a different elevation than the crankshaft. Thus, when the feeder mechanism and the ram carriage have been driven by a common drive and mechanically interconnected in the past, it has been necessary to transmit the driving power for the feeder mechanism through a series of gears or couplings, each of which permits some unintended relative movement or "looseness" between relatively moving adjacent components. More particularly, prior art feeder mechanisms are driven by and timed through a series of chains, sprockets, shafts and gearboxes with the crankshaft which drives the punch ram. While the arrangements for mechanically interconnecting the punch ram crankshafts and the feeder mechanism cams in the prior art generally have proved highly successful, several problems remain. It is difficult to keep the feeder mechanism cam in time with the crankshaft with such arrangements due to the number of inputs and outputs that the power goes through before it gets to the feeder mechanism cam. Moreover, for purposes of controlling the timing of the movement between the punch ram crankshaft and the feeder mechanism, the amount of relative movement between each of the components of the sprockets, chains and gears in the drive train to the feeder mechanism is cumulative. As a consequence of this relative movement between the drive train components, it sometimes occurs that the critical phase relationship between the movement of the punch ram crankshaft and the feeder mechanism is lost. Such loss of this critical phase relationship results in a misfeed of a cup blank, and the damage of the blank, punch ram and dies discussed above. The problems of "looseness" between the drive train components is one that is compounded when the components experience wear. Furthermore, all of the chains, sprockets, shafts and gearboxes used for these drive trains require high levels of maintenance.

Moreover, the damage from the misfeed of a cup blank normally is not limited to that resulting from the destruction of a single blank cup. The mass of the ram carriage typically is so great in prior art body making machines that it is not feasible to adequately brake the movement of the punch ram once a misfeed occurs and is detected. Thus, in prior art machines, the punch ram, will generally make two to three strokes after the misfeed is detected. While the feeder mechanisms of the prior art generally include escapement systems that limit the number of cup blanks being feed to the locator structure, there is typically at least one additional cup blank, in addition to the misfed cup blank that is feed to the locator structure after the misfeed. Since fragments of the misfed cup blank will remain in the locator structure and dies, the subsequently fed cup blank also is destroyed as it is contacted by the punch ram, and the metal from the subsequent cup blank further damages the punch ram and the dies.

SUMMARY OF THE INVENTION

Accordingly, it is an object of the invention to provide an improved can body making apparatus that more precisely establishes and more reliably maintains the phase relationship between the movement of the punch ram and the feeding mechanism.

It is another object of the invention to provide an improved can body making apparatus that has fewer misfeeds of cup blanks by the feeding mechanism.

Still another object of the invention is to provide an improved can body making apparatus that reduces the severity of damage resulting from the misfeed of a cup blank.

Yet another object of the invention is to provide an improved can body making apparatus with a feeding mechanism that can be quickly stopped in the event of a cup blank misfeed.

A still further object is to provide an improved can body making apparatus that allows quicker setup of the phase relationship of the movement of a punch ram and a feeder mechanism.

It is yet another object of the present invention to provide a feed mechanism that corrects out-of-roundness problems of cup blanks before the cup blanks are drawn through the dies.

Another object of the invention is to provide an can body making apparatus that allows much more precise timing and maintenance of the movement of a feeder mechanism, which is increasingly important as the speed of can body making apparatuses is increased.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention disclosed herein, an improved can body making apparatus is provided. The apparatus includes a base that supports a way system upon which a punch ram is reciprocally movable. The punch ram is adapted to contact a preformed cup blank and to force the cup blank through one or more dies. A first drive system is mechanically interconnected to the punch ram for reciprocally moving it through a range of movement on the way system. A locating structure is provided for locating a cup blank at a precise predetermined position within the punch ram's range of movement where it is contacted by the punch ram. A feeder mechanism moving the cup blanks into the locating structure, with a second drive system moves the feeder mechanism in timed phased relationship to the movement of the punch ram. The second driving system is mechanically connected to the feeder mechanism but is mechanically uncoupled with the first drive system. A master encoder generates a control signal representative of the position of the punch ram and a controller responsive to the control signal generated by the master encoder is operative to control the timed phased relational movement of the second drive system relative to the movement of the punch ram.

The second drive system preferably includes a servo motor that includes a rotatable shaft for moving the feeding mechanism. An encoder also is provided for generating a signal representative of the angular position of the servo motor shaft.

According to one aspect of the invention the controller is operative to control rotation of the servo motor shaft in accordance with movement of the first drive system. In the preferred embodiment, the controller is responsive to the signal which is representative of the angular position of the servo motor shaft, and synchronizes movement of the servo motor shaft with movement of the first drive system.

According to a specific aspect of the invention, the first drive system includes a rotatable crankshaft, and the controller synchronizes movement of the crankshaft and the servo motor shaft.

In another aspect of the invention, a switch is provided for manually setting and adjusting the desired phase relationship between the first drive system and the servo motor shaft.

According to yet another aspect of the invention, a rotary feed mechanism is provided for feeding cup blanks to a can body making apparatus. The rotary feed mechanism includes a frame and a locating structure that is fixedly secured relative to the frame. The locating structure functions to accurately position and align a cup blank to be contacted by a punch ram. The locating structure has a curved cup locating surface that has a substantially constant predetermined radial distance from a predetermined point. A cam is rotatably journaled in the frame about a rotational axis. The cam has a contact surface about its periphery for contacting a cup blank and moving the cup blank from a predetermined pickup location to the cup locating surface. The cam is configured so that the most radially outward portion of its periphery with respect to the rotational axis is spaced from the predetermined point by a distance approximately equal to the radius of the cup. With this configuration, the most radially outward portion of the cam will contact a cup blank positioned in the cup locating surface if the cup blank is out-of-round thereby correcting out-of-roundness problems of the cup blanks and further reducing misfeeds.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different obvious aspects all without departing from the invention. Accordingly, the drawings and description will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings, wherein like numerals indicate the same elements throughout the views.

DETAILED DESCRIPTION OF THE PREFERRED EMBODIMENT

Figure 1:
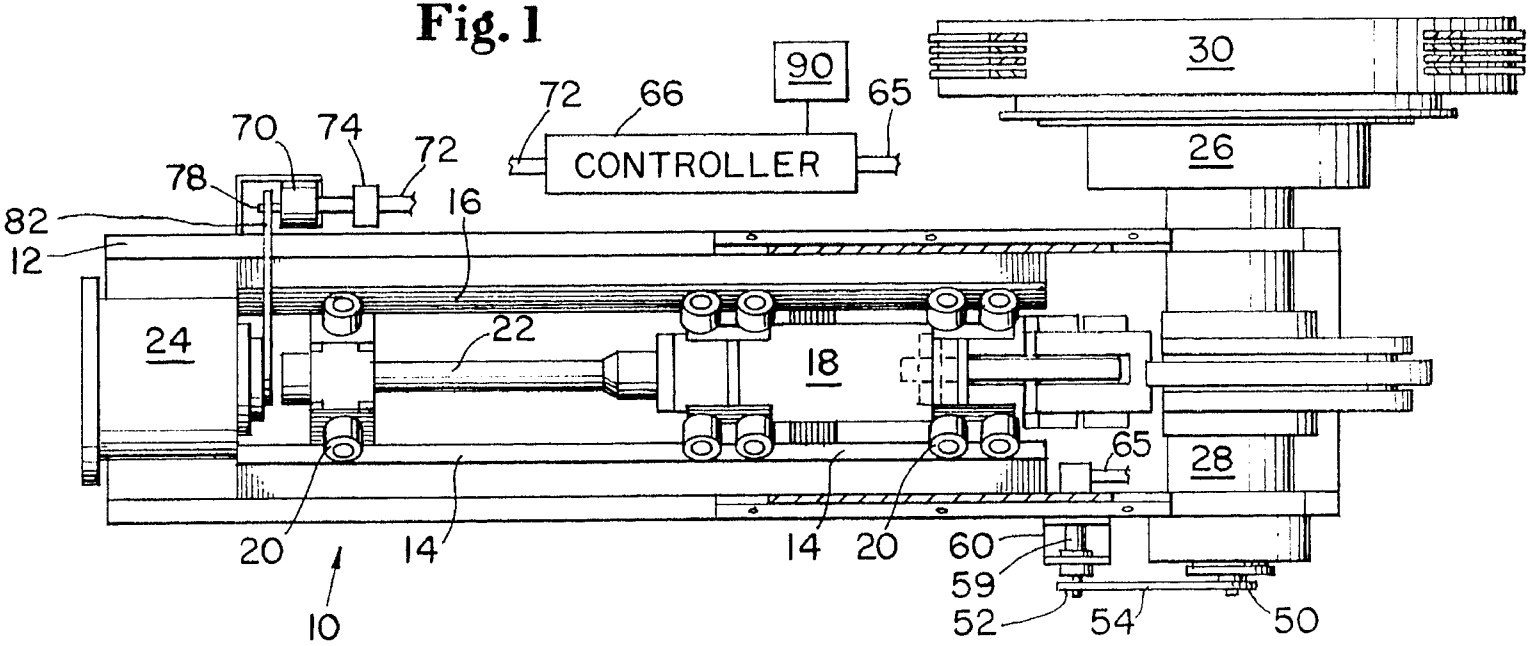
FIG. 1 is a plan view of a can body making apparatus constructed in accordance with the principles of the present invention.

Referring now to the drawings, FIG. 1 shows a can body making apparatus, generally identified by the drawing numeral 10, that is constructed in accordance with the present invention. The can body apparatus 10 includes a base or frame structure 12 that includes a spaced pair of inclined surfaces 14 and 16, which inclined surfaces 14 and 16 jointly form a way system for the movement of a rollable ram carriage 18. The ram carriage 18 includes a plurality of wheels, each of which is identified by the numeral 20. These wheels 20 rotatably support the ram carriage 18 on the base 12 and permit the ram carriage 18 to roll back and forth on the way system formed by the inclined surfaces 14 and 18. The ram carriage 18 supports and carries a punch ram 22 which is adapted for contacting pre-drawn aluminum cup blanks and forcing the cup blanks through a series of progressive dies contained in a die pack 24.

The punch ram 22 is moved on the ram carriage 18 and moved along the way system formed by inclined surfaces 14 and 18 by a motor (not shown). The motor rotates a crankshaft 28 and that converts the rotary movement of the motor into reciprocal movement of the ram carriage 18. Such reciprocal movement of the ram carriage 18 moves the punch ram 22 axially into and out of the progressive series of dies contained in die pack 24, which dies are aligned with the axial movement of the punch ram 22. A flywheel 30 is attached to the crankshaft 28 to keep the crankshaft 28 rotating at a steady speed.

Figure 3:
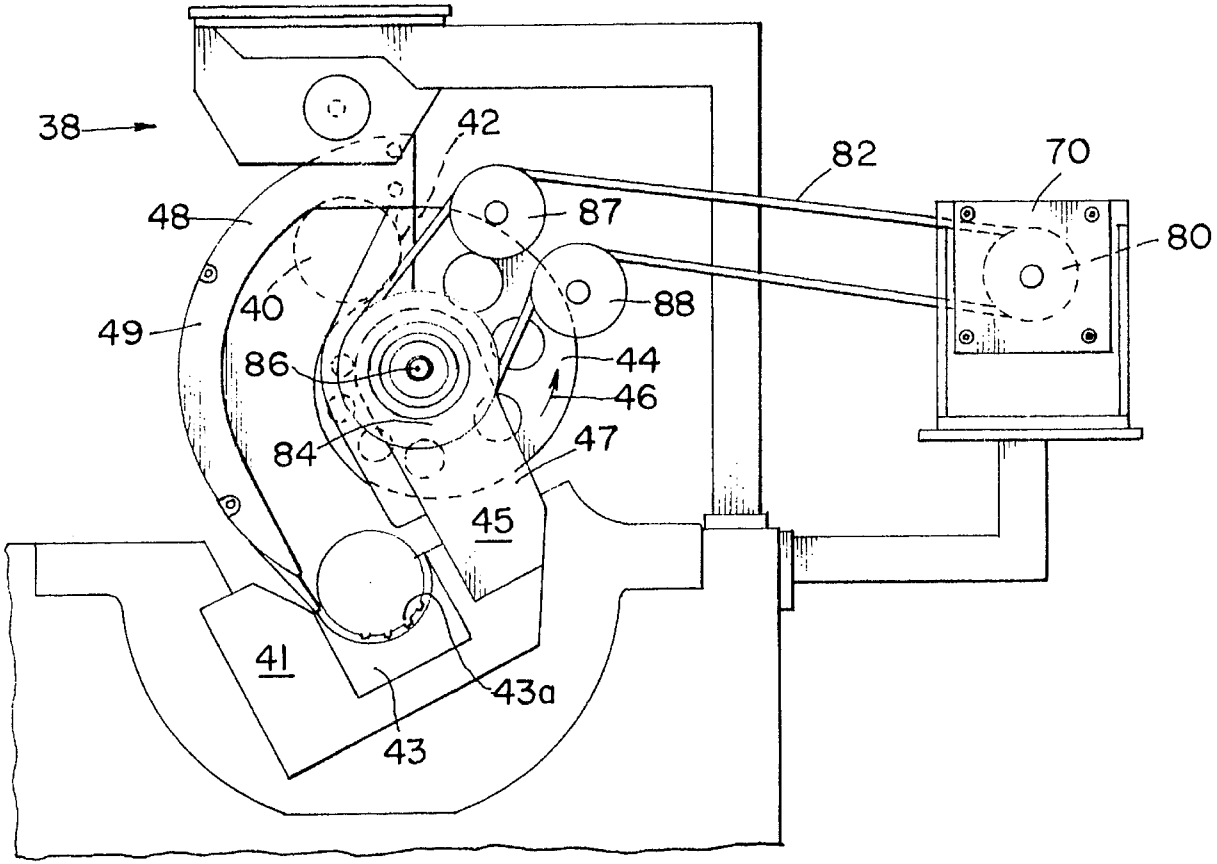
FIG. 3 is an elevational view of the cup blank feeder mechanism of the can body making apparatus of FIG. 1.

A rotary cup feed mechanism, generally identified by the numeral 38 in FIG. 3, is used to feed a single cup blank 40 into proper positioning and alignment for contact by the punch ram 22. The feed mechanism 38 includes a cup locator plate 41 which supports a cup locator 43 and a frame 45. The frame 45 includes a cam support arm 47 that is used to rotatably support a cam 44. A bracket 48 also is used to further support a curved track 49 for guiding movement of cup blanks being moved by the cam 44. As indicated by the arrow 46, the cam 44 is rotated counterclockwise as viewed in FIGS. 3 and 4.

The pre-drawn can blanks 40 to be contacted and drawn into the die pack 24 by the punch ram 22 are loaded from the top of the can making apparatus 10 and individually dropped by an escapement mechanism (not shown) to a cam pickup location against the periphery of the rotating cam 44. As shown in FIG. 3, a curved surface 42 of a rotating cam 44 successively contacts the periphery of individual cup blanks 40 at this pickup location and indexes the cup blanks 40 to a predetermined redraw position that is precisely defined by a cup locator 43. The cup locator 43 includes an outer cup locator surface **43*a* having a curvature generally corresponding to that of the cup blank 40. As those skilled in the art will readily appreciate, the cup locator surface 43*a* functions to stop movement of the cup blank 40 after the cup blank 40 is released by the cam surface 42, and to insure that the cup blank 40 is properly and precisely positioned and aligned to be contacted by the punch ram 22. With the cup blank 40 precisely located and aligned against the cup locator surface 43*a*, a cylindrical redraw sleeve (not shown) is axially moved into the cup blank 40, and the punch ram 22 thereafter is axially advanced to contact the cup blank 40 and to draw it through the series of dies in the die pack 24**.

Figure 2:
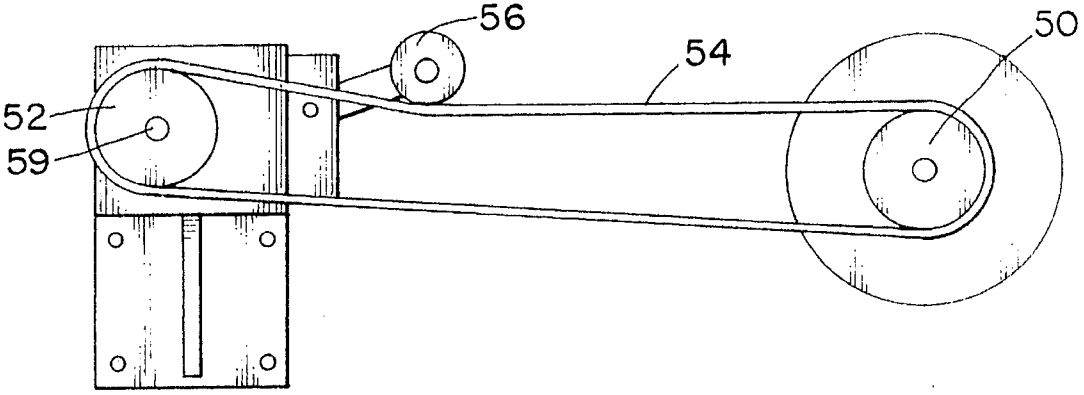
FIG. 2 is a side elevational view of a line driver and crankshaft pulley shown in FIG. 1.

As will be readily apparent to those skilled in the art, the timing relationship between the rotation of the cam 44 and the movement of the punch carriage 18 is critical for successful operation of the above-described rotary cup feeding mechanism. In accordance with the principles of the present invention, the timing relationship between these elements is controlled in an improved manner. Referring jointly to FIGS. 1 and 2, it will be seen that the can making apparatus 10 further includes a first timing pulley 50 that is mechanically interconnected to the crankshaft 28 for common rotation therewith. The timing pulley 50 is further connected to an encoder pulley 52 by a timing belt 54. Tension is maintained on the timing belt 54 by an idler pulley 56. The encoder pulley 52 is mechanically attached to the shaft 59 of a master line driver encoder 60 which generates electrical pulse signals that are representative of the angular position of the shaft 59 and sends these electrical pulses by way of a conductor 65 to a controller 66. The master line driver encoder 60 of the preferred embodiment is a BEI Model XH25DSS1000ABZC8830LE encoder manufactured by BEI Motion Systems Company of Goleta, Calif. that generates 4000 pulses per revolution of the shaft 59 with one marker pulse per revolution. The controller 66 of the preferred embodiment is an Electro-Craft IQ Series 2000 positioning control module manufactured by Reliance Motion Control of Eden Prairie, Minn.

The controller 66 communicates with a servo motor 70 through a conductor 72. The servo motor 70, which in the preferred embodiment is a Model F4030 servo/encoder manufactured by Electro-Craft, further includes an encoder 74, that generates 4000 pulses per revolution of the servo motor 70 with one marker pulse per revolution. The output of the encoder 74, which is a signal indicative of the angular position of a shaft 78 of the servo motor 70, also is input to the controller 66. As explained in greater detail later below, the controller 66 synchronizes rotation of the servo motor 70 with the rotation of the master encoder 60 by generating a control signal that is used to control the speed and relative angular position of a servo motor 70.

The servo motor 70 is, in turn, used to drive the rotary cup feed mechanism 38. As most clearly shown in FIG. 3, the servo motor 70 has an output pulley 80 that rotates a timing belt 82 used to drive the cam 44 of the cup feed mechanism 38. A pulley 84 connected to a shaft 86 for the cam 44 receives the timing belt 82. The timing belt 82 also includes two idler pulleys 87 and 88 that guide the direction of the timing belt 82.

As noted above, successful operation of the body making apparatus requires the cam 44 to rotate in precise timed relationship to the movement of the punch ram 22. Since the punch ram 22 is moved by the crankshaft 28, this relative timing between the punch ram 22 and the cam 44 can be achieved by controlling the angular phase relationship between the crankshaft 28 and the cam 44.

As suggested by the relative sizes of the pulleys 80 and 84, there is a 2:1 ratio between the rotation of the servo motor pulley 80 and the feed mechanism pulley 84 of the preferred embodiment. Thus, the servo motor 70 will rotate through two marker pulses for each revolution of the feed mechanism pulley 84. Hence, in initially establishing the proper phase relationship between the crankshaft 28 and the servo motor 70, it is necessary to establish the marker pulse from which measurements will be made. In the preferred embodiment, this is achieved by first activating the servo motor 70 to rotate the cam 44 to bring a predetermined position that brings a magnetic insert (not shown) on the cam 44 into a position to activate a proximity switch (not shown) on the tool housing. When this position is reached, the servo motor 70 is further rotated to the next marker pulse of the servo encoder 74 and the servo motor 70 is stopped at that location. The crankshaft 28 then is rotated to bring the master encoder 60 to a pulse mark. Once a pulsar mark of the master encoder 60 is reached, both the crankshaft 28 (as well as the encoder 60) and the servo motor 70 are rotated. The controller 66 then adjusts the relative rotation of the servo motor 70 by advancing or retarding the rotation to synchronize the rotation of the crankshaft and the servo motor 70, and the servo motor 70 is rotated in a one-to-one relationship with the rotation of encoder 60 (which rotates in a one-to-one relationship with the crankshaft 28).

Once the rotation of the crankshaft 28 and the servo motor 70 are synchronized, it is necessary to set the phase relationship between the rotation of these two elements so that the cam 44 will index a cup blank 40 into the cup locator surface **43*a* at the appropriate time to be contacted by the punch ram 22. This desired phase relationship between the crankshaft 28 and the cam 44 is set in the illustrated embodiment by manually advancing or retarding the rotation of the servo motor 70 with a manual pulse switch 90. Once this desired phase relationship is reached, the relative position of the servo motor 70 to the crankshaft 28 is recorded in the controller 66, and the controller operates the servo motor 70** in that phase relationship until the controller receives a disable signal, which can be generated in response to a misfeed or other conditions, such as an opening of a guard or cover or the pressing of a manual emergency stop button.

Figure 4:
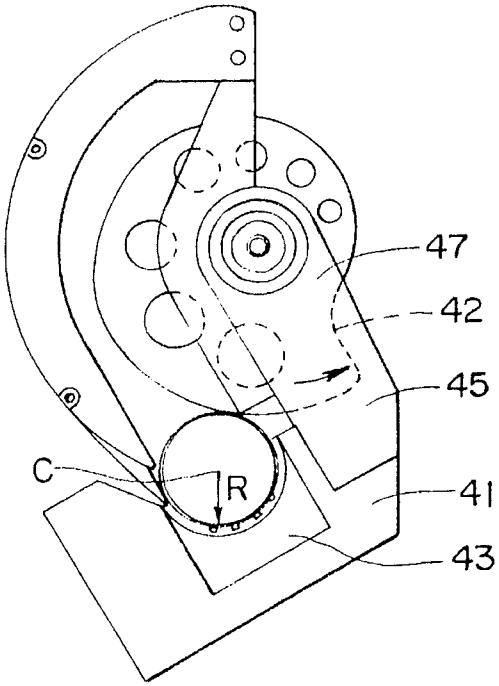
FIG. 4 is a fragmentary view of the feeder mechanism of FIG. 3 showing the cam in a rotated position in which it insures the roundness of the cup blank.

Accordingly to another aspect of the invention, the profile of the cam 44 has been set to correct out-of-roundness problems that are occasionally experienced with cup blanks. More specifically, the cam 44 is sized and located so that its radially outermost portion travels along a path that closely approximates the radially outermost portion of an appropriately rounded cup blank 40 that is positioned in the cup locator 43. With such an arrangement, the cam 44 will strike and reshape any cup blank that is out-of-round as shown in FIG. 4. In the illustrated embodiment, the curved surface of the cup surface 43*a* has a radius R and is equidistant from a point C, with the path of travel of the radially outermost portion of the cam 44 being spaced from point C by a distance of approximately the distance R.

In summary, numerous benefits have been described which result from employing the concepts of the invention. The invention allows the feed mechanism to be driven in precise timed relationship to the movement of a punch ram in a manner that is not susceptible to errors resulting form "play" in the drive train between the crankshaft and the feed mechanism. It also eliminates the timing problems that have been created in the past from wear of the drive train components. Advantageously, the feed mechanism of the invention can be stopped immediately. Once a misfeed is detected, as for example by detecting increased electrical power demand of the servo motor 70, the controller 66 immediately stops movement of the servo motor 70. Thus, while the punch ram 22 may still continue to move for several strokes after the detection, further infeed of the cup blanks is terminated. Consequently, damage to the punch ram and the dies is reduced significantly. Furthermore, if the system is stopped, the desired phase relationship that was stored in the controller 66 by operating the switch 90 can be recalled, and the controller 66 can automatically adjust the movement of the servo motor to obtain the desired relationship.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, those skilled in the art will readily appreciate that the punch ram can be moved by structures other than ram carriages. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An improved can body making apparatus, comprising:

a) a base;

b) a way system supported by the base;

c) a punch ram reciprocally movable on the way system, the punch ram being adapted for contacting a preformed cup blank and forcing the cup blank through one or more dies;

d) a first drive system for moving the punch ram on the way system, the first drive system being mechanically interconnected to the punch ram for reciprocally moving the punch ram through a range of movement relative to the base;

e) a locating structure for locating a cup blank at a position to be contacted by the punch ram at a predetermined position within the punch ram's range of movement;

f) a feeder mechanism for moving cup blanks into the locating structure;

g) a second drive system for moving the feeder mechanism in timed phased relationship to the movement of the punch ram, the second driving system being mechanically connected to the feeder mechanism but being mechanically uncoupled to the first drive system;

h) an encoder for generating a control signal representative of the position of the punch ram; and i) a controller for controlling movement of the second drive system, the controller being responsive to the control signal generated by the encoder and being operative to control the timed phased relational movement of the second drive system relative to the movement of the punch ram.

2. An improved can making apparatus as recited in claim 1 wherein the second drive system includes a servo motor for moving the feeder mechanism, the servo motor including a rotatable shaft for moving the feeding mechanism, and further including an encoder for generating a signal representative of the angular position of the servo motor shaft.

3. An improved can making apparatus as recited in claim 2 wherein the controller is operative to control rotation of the servo motor shaft in accordance with movement of the first drive system.

4. An improved can making apparatus as recited in claim 3 wherein the controller is responsive to the signal representative of the angular position of the servo motor shaft, and synchronizes movement of the servo motor shaft with movement of the first drive system.

5. An improved can making apparatus as recited in claim 4 wherein the first drive system includes a rotatable crankshaft, and the controller synchronizes movement of the crankshaft and the servo motor shaft.

6. An improved can making apparatus as recited in claim 4 further including a switch for manually adjusting the phase relationship between the first drive system and the servo motor shaft.

7. An improved can making apparatus as recited in claim 1 wherein the punch ram is carried by a ram carriage.

* * * * *

UNITED STATES PATENT AND TRADEMARK OFFICE

CERTIFICATE OF CORRECTION

PATENT NO. : 5,572,891
DATED : November 12, 1996
INVENTOR(S) : Klein et al.

It is certified that error appears in the above-indentified patent and that said Letters Patent is hereby corrected as shown below:

Column 5, line 4 delete "moved" and insert in place thereof --reciprocally mounted--.

Signed and Sealed this

Sixth Day of May, 1997

*Attest:*

BRUCE LEHMAN

*Attesting Officer*

*Commissioner of Patents and Trademarks*